United States Patent [19]

Marotto et al.

[11] Patent Number: 4,979,768

[45] Date of Patent: Dec. 25, 1990

[54] DEADBOLT BACKSET LATCH WITH INTERLOCK

[75] Inventors: Robert A. Marotto; Mohamed L. Benchaar, both of Auburn, Ala.

[73] Assignee: Dexter Lock Company, Auburn, Ala.

[21] Appl. No.: 399,671

[22] Filed: Aug. 28, 1989

[51] Int. Cl.[5] ..... E05B 9/00

[52] U.S. Cl. ..... 292/337; 70/461; 292/DIG. 74

[58] Field of Search ..... 70/461, 134; 292/1, 292/337, DIG. 60, DIG. 74

[56] References Cited

U.S. PATENT DOCUMENTS

| | | | |
|---|---|---|---|
| 1,661,454 | 3/1928 | Wilson . | |
| 2,775,475 | 12/1956 | Miller | 292/DIG. 74 X |
| 3,112,944 | 12/1963 | Adler | 292/DIG. 74 X |
| 4,372,594 | 2/1983 | Gater | 292/337 |
| 4,564,229 | 1/1986 | Mullich et al. | 292/337 X |
| 4,602,490 | 7/1986 | Glass et al. | 292/337 X |
| 4,653,787 | 3/1987 | Fang | 292/337 |
| 4,664,433 | 5/1987 | Solovieff . | |
| 4,725,086 | 2/1988 | Shen | 292/337 |
| 4,729,585 | 3/1988 | Lin | 292/DIG. 60 X |
| 4,759,576 | 7/1988 | Ching . | |
| 4,772,055 | 9/1988 | Fang | 292/337 |

*Primary Examiner*—Gary L. Smith
*Assistant Examiner*—Suzanne L. Dino
*Attorney, Agent, or Firm*—Pennie & Edmonds

[57] ABSTRACT

An adjustable deadbolt backset latch arrangement having a bolt train including a deadbolt in which the deadbolt is arrested by action of a turntable shuttle to permit backset adjustment of the latch arrangement.

6 Claims, 7 Drawing Sheets

DEADBOLT BACKSET LATCH WITH INTERLOCK

BACKGROUND OF THE INVENTION

Adjustment of the backset of latches have included slot and pin arrangements in which the latch components are rotated and reciprocated to accomplish backset adjustment (U.S. Pat. Nos. 1,661,454 and 4,372,594) and backset adjustment has also been accomplished using movable pin and spring-loaded pins and pin-receiving recesses (U.S. Pat. Nos. 4,653,787 and 4,602,490).

SUMMARY OF THE INVENTION

Broadly, the present invention comprises an adjustable deadbolt latch in which, as a movable housing section is adjustable to various lengths and the bolt train is simultaneously adjustable using a slot and pin arrangement and in which a turnable shuttle element engages and holds a portion of the bolt train in fixed relationship with the stationary housing section during adjustment.

It is a feature of the invention that the turnable shuttle operates only when the bolt train is extended to its lock position and a housing portion turned.

DESCRIPTION OF THE PREFERRED EMBODIMENT

Figure 1:
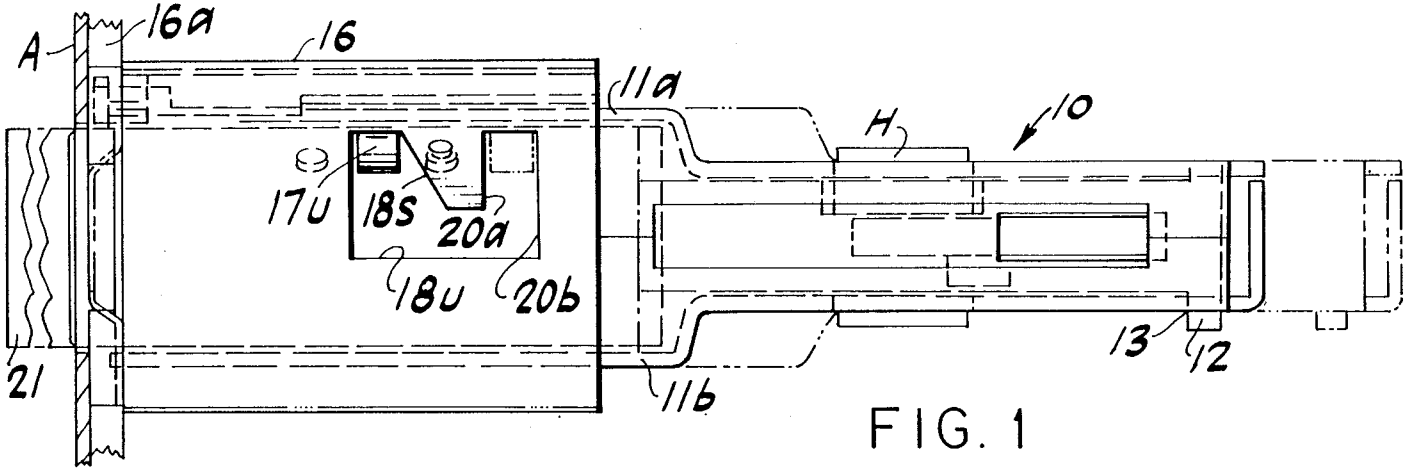
FIG. 1 is a plan view of the deadbolt backset latch mechanism.

In FIGS. 1–4, backset mechanism 10 includes housing case halves 11*a*, 11*b* comprising casing housing 11 connected together through crosspiece 12 projecting from half 11*b* and located in slot 13 of half 11*a*. Case halves 11*a*, 11*b* which include flat side portions 11*c* and opening 11*d*, as assembled are slidably positioned in cylindrical housing 16 with two (2) raised followers 17*u* and 17*l* (not shown), each positioned 180° apart in a configured opening 18 *u* and 18*l* which are also spaced 180° apart. Opening 18*u* includes slant side 18*s* and guide sides 20*a*, 20*b*. Also shown is swivel H and back plate 16*a* and fore plate A.

Figure 2:
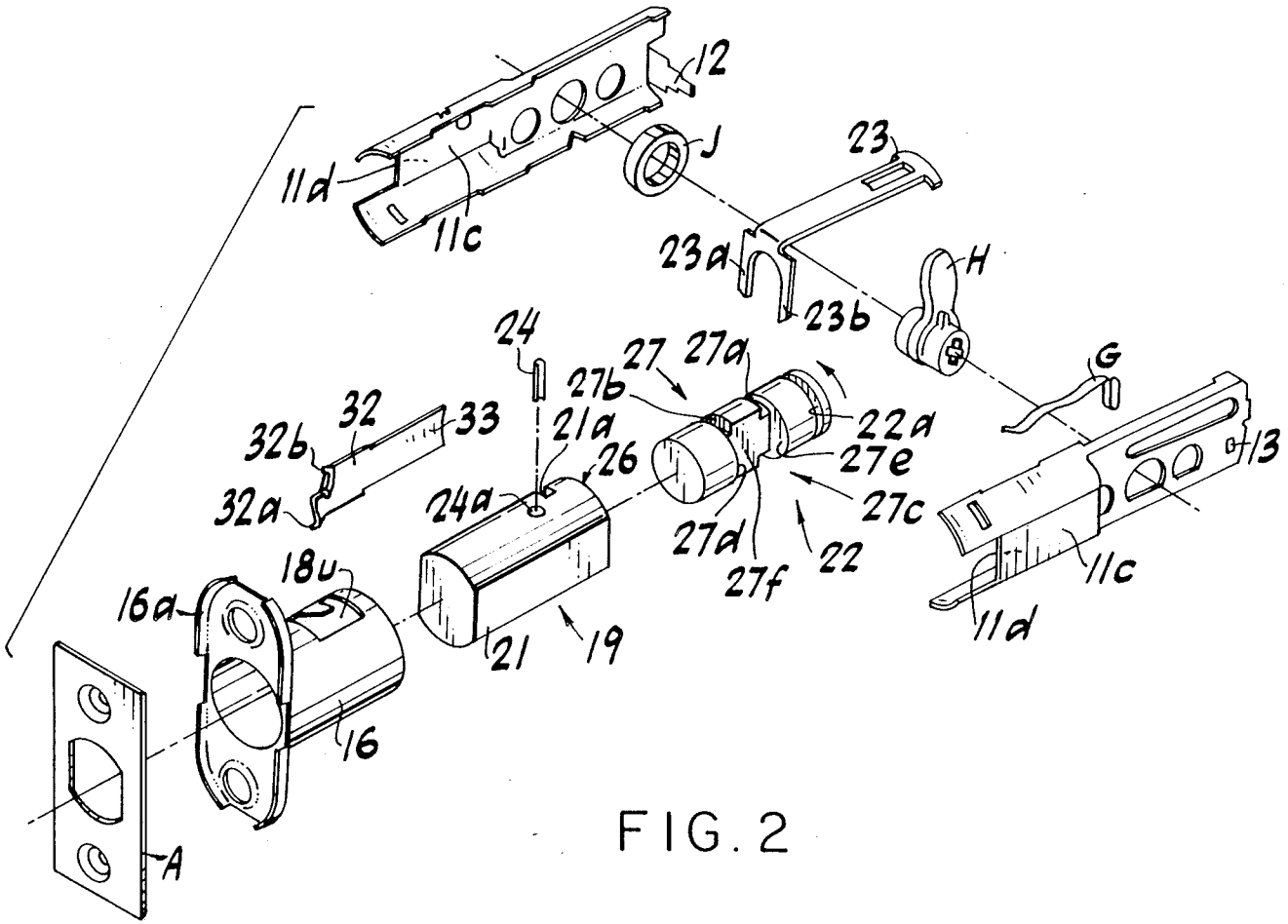
FIG. 2 is an exploded perspective view of the mechanism.
Figure 9:
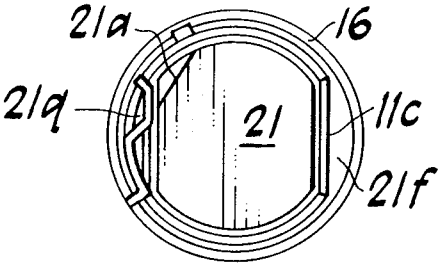
FIG. 9 is an end elevational view of the mechanism with the shuttle shown disengaged from the bolt.

Turning particularly to FIG. 2, bolt train 19 includes flat-sided deadbolt 21; adjustable bolt adjustment plug 22 and L-shaped bolt train driver 23. Driver tongs 23*a*, 23*b* grip ring groove 22*a* of plug 22 so that plug 22 turns when driver 23 turns. Since driver 23 is housed in housing 11, the turning of housing 11 causes plug 22 to turn. Deadbolt 21 of bolt train 19 is located in housing 16 leaving, due to the flat-sided configuration of bolt 21, spaces 21*g* and 21*h* on either side (FIG. 9). Deadbolt 21 includes bolt groove 21*a*. The effective length of bolt train 19 is changed by axially moving the bolt plug 22 within recess 26 of deadbolt 21 and thereafter locking bolt 21 to plug 22 as hereafter further described.

Deadbolt plug pin 24 projects through bolt hole 24*a* into bolt internal recess 26 and engages in U-shaped bolt plug track 27. Track 27 includes remote cross groove 27*a*, near cross groove 27*b* and longitudinal notch 27*c* defined by cross walls 27*d*, 27*c* and transverse wall 27*f*. Turnable shuttle 32 includes curved body 33, anchor extension 32*a* and a deadbolt arrestor piece 32*b*. Pin 24 rides in grooves 27*a*, 27*b* and notch 27*c* to accomplish backset adjustment. Also shown in FIG. 2 is shuttle 32 which is, at all times, held against axial movement by anchor extension 32*a* positioned between plates A and 16*a* (FIGS. 1 and 2).

Figure 11:
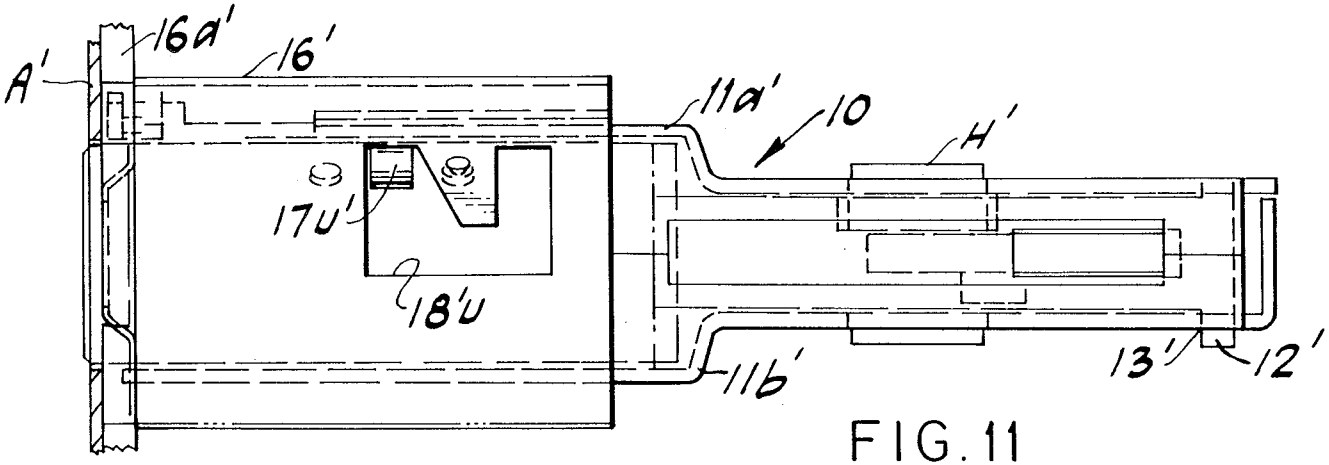
FIG. 11 is a plan view of a second embodiment of the invention.
Figure 10:
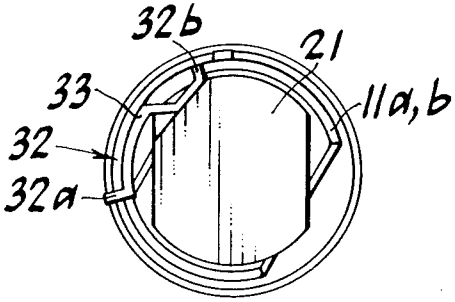
FIG. 10 is an end elevational view of the mechanism with the shuttle engaged to the bolt.
Figure 13:
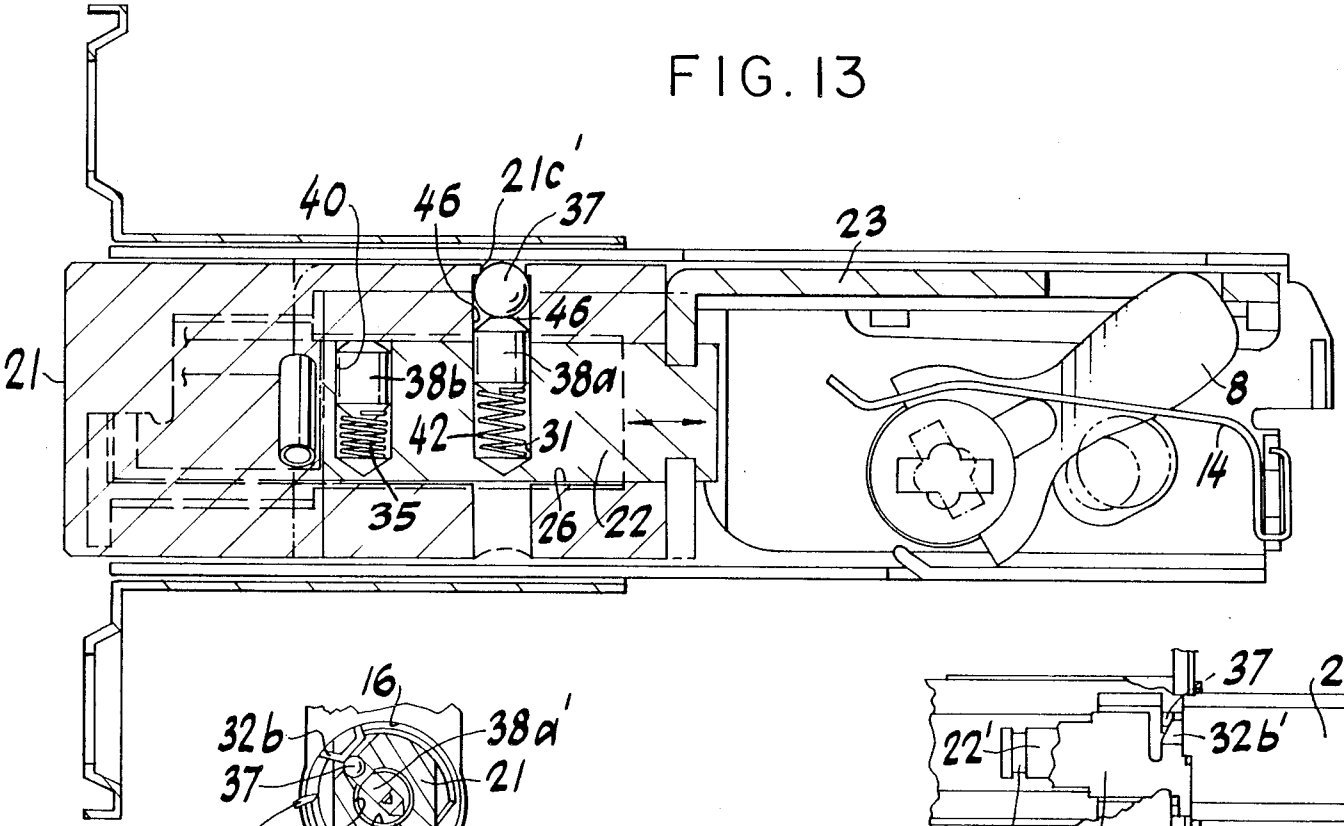
FIG. 13 is a longitudinal sectional view through the mechanism with the bolt retracted.

Backset adjustment is accomplished by first placing deadbolt 21 in its extended position (FIG. 1) through rotating handle H to its forward position (handle H is shown in its retracted position in FIGS. 11 and 13). In its extended position, deadbolt 21 is sufficiently forward to permit casing housing 11 to be partially turned with flat-sided bolt 21 (which is not rotated) entering into housing openings 11*d* as housing 11 turns (FIG. 10). Cylindrical housing 16 remains fixed, as casing housing 11 including halves 11*a*, 11*b*, is turned to rotate shuttle 32 to cause shuttle arrestor piece 32*b* to move into deadbolt groove 21*a* (FIGS. 2, 9 and 10). In this position, deadbolt 21 is held against longitudinal movement in either the forward or backward direction. In this housing-rotated position, bolt plug 22 is rotated so that deadbolt pin 24 is positioned in lateral notch 27*c* permitting bolt plug 22 to be movable axially to either 2⅜ or the 2¾ position as desired. To complete adjustment, case halves 11*a*, 11*b* are rotated back to their normal position causing shuttle arrestor piece 32*b* to withdraw from deadbolt slot 21*a* and pin 24, held by bolt 21, to enter into cross groove 27*a* or 27*b* as plug 22 is turned.

During rotation of housing 11 which carries with driver 23, plug 22, blister 17*u* and its 180° opposite blister 171 moves in openings 18*u* and 181 respectively. Follower 17*u* is guided by walls 20*a*, 20*b* of 18*u* in completing the 2¾" setting and 17*l* is guided by walls 20*c*, 20*d* of opening 18*l* completing the 2¾" setting. Movement of blisters 17*u*, 17*l* in openings 18*u*, 18*l* provides for backset adjusting of casing 16 vis-a-vis casing 11.

Figure 4:
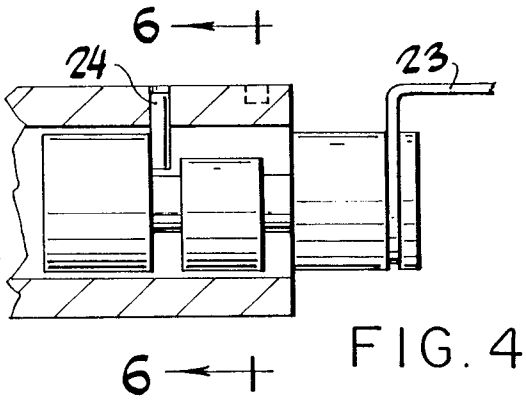
FIG. 4 is a partial sectional view through plug and deadbolt showing the mechanism being adjusted to the 2¾" position.
Figure 6:
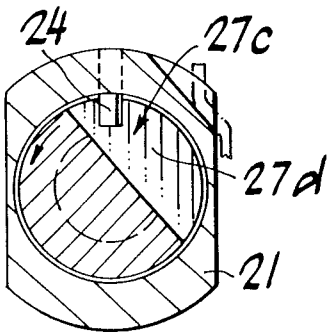
FIG. 6 is a sectional view along line 6—6 of FIG. 4.
Figure 3:
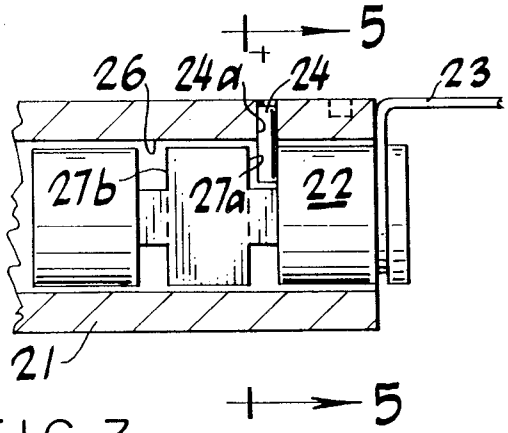
FIG. 3 is a partial sectional view through plug and deadbolt showing the 2⅜" backset position.
Figure 5:
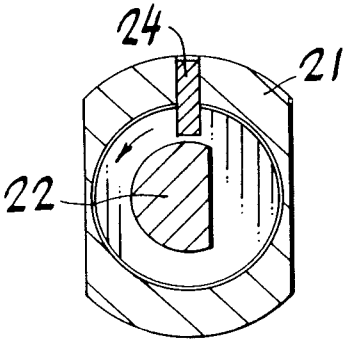
FIG. 5 is a sectional view along line 5—5 of FIG. 3.

Turning to FIGS. 3–6, deadbolt pin 24 is secured in bolt hole 24*a*. Pin 24 extends down into bolt recess 26 in which plug 22 is reciprocated and turned through engaged driver 23 to allow pin 24 to reciprocate in notch 27*d* (FIGS. 4 and 6). Notch 27*c* is defined by end surfaces 27*d* and 27*e* (FIG. 2). Backset adjustment is blocked when pin 24 is in groove 27*a* or 27*b*, the two backset positions being 154 " apart.

Figure 7:
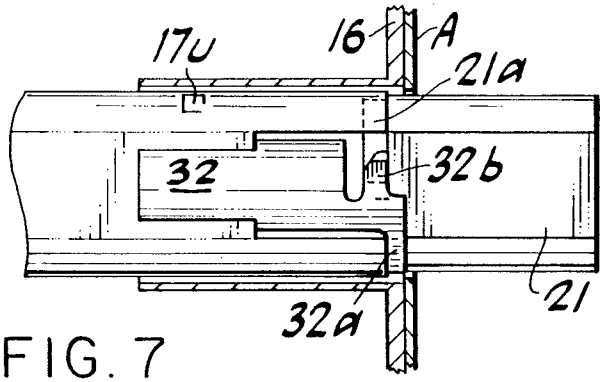
FIG. 7 is a partially cutaway side view of the mechanism showing the shuttle disengaged from the bolt.
Figure 8:
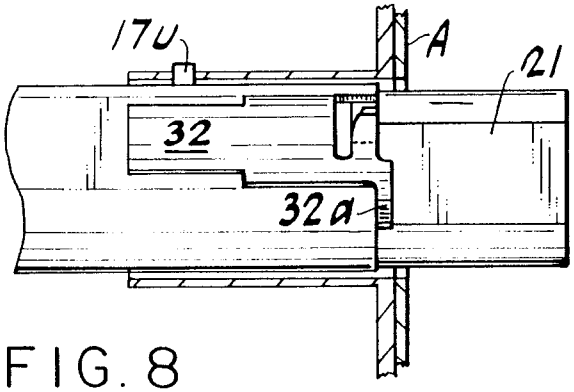
FIG. 8 is a partially cutaway side view of the mechanism showing the shuttle engaged with the bolt.

FIGS. 7–10 illustrate the operation of shuttle 32 which is rotated by housing 11 into and out of bolt groove 21*a*. When shuttle arrestor 32*b* enters groove 21*a* it prevents longitudinal movement of deadbolt 21 during backset adjustment. FIGS. 7 and 9 show shuttle 32 including arrestor 32*b* withdrawn from bolt groove 21*a* while FIGS. 8 and 10 show shuttle 32 engaged with bolt 21. Flat-sided deadbolt 22 provides spaces 21*g* and 21*f* (see FIG. 9).

Turning to FIGS. 11–16 and the second embodiment, backset mechanism 10', includes housing case halves 11*a'*, 11*b'* connected together through crosspiece 12' projecting from half 11*b'*, and located in slot 13' of half 11*a'*, Case halves 11*a'*, 11*b'* as assembled are slidably positioned in cylindrical back plate outer cylindrical housing 16' with followers 17*u'*, 18*l'* positioned in configured slot openings 18*u'*, 18*l'*. Also shown is swivel H' and back plate 16*a'* and for plate A'.

Figure 12:
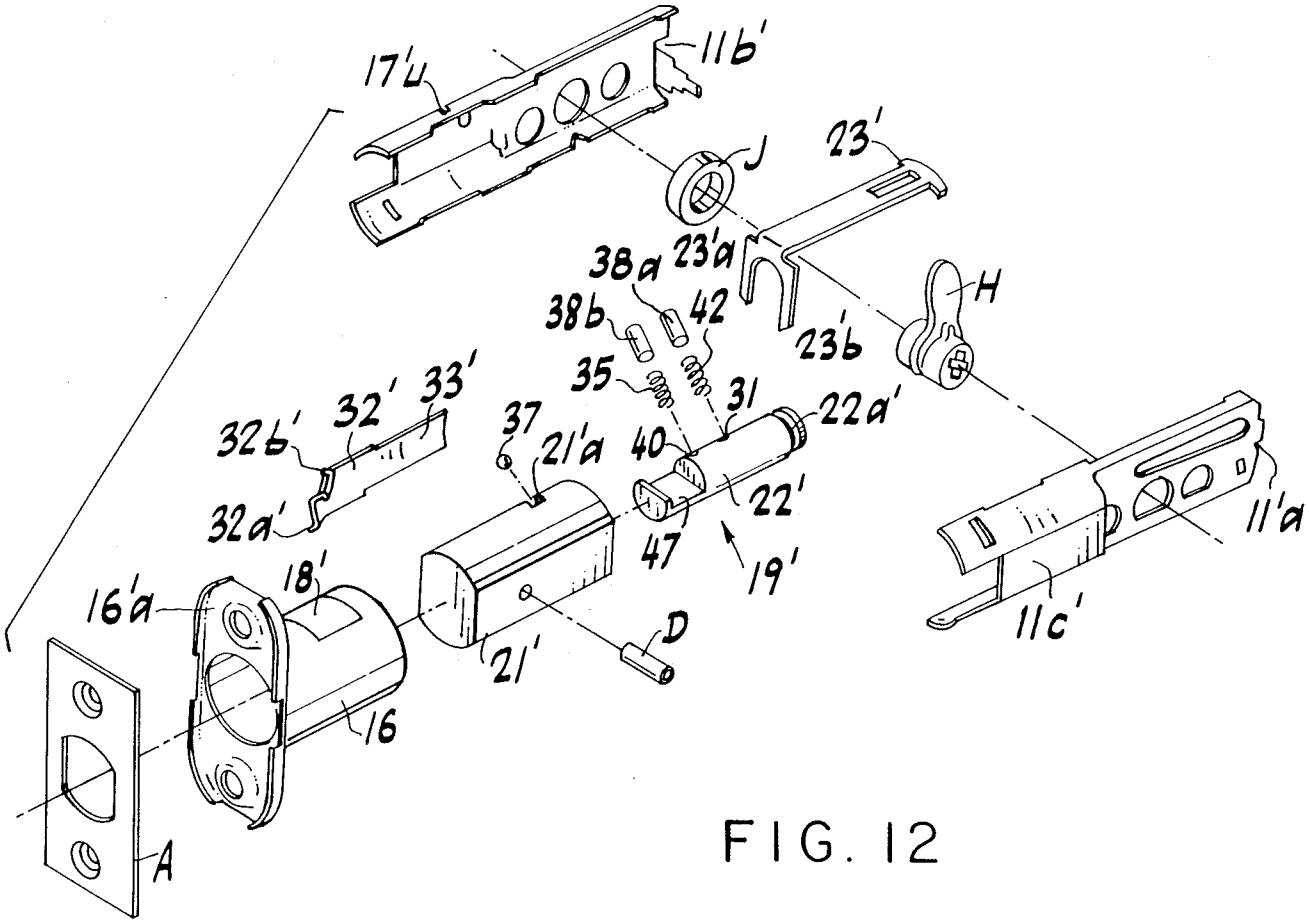
FIG. 12 is an exploded perspective view of the second embodiment mechanism.
Figure 14:
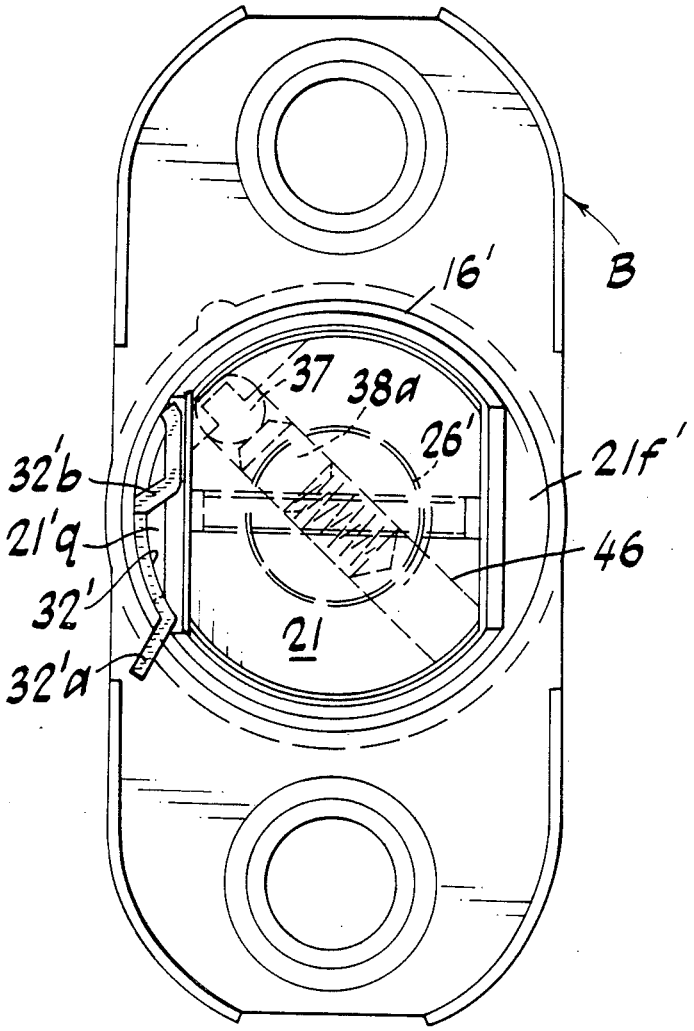
FIG. 14 is a transverse sectional view through the mechanism showing the shuttle disengaged.

Bolt train 19' includes flat-sided deadbolt 21'; adjustable bolt plug 22' and bolt train driver 23'. Deadbolt 21' of bolt train 19' is located in housing 16' leaving, due to the flat-sided configuration of bolt 21', spaces 21*g'* and 21*h'* on either side (FIG. 14). The effective length of bolt train 19' is changed by axially moving the bolt body plug 22' within recess 26' of deadbolt 21'. Adjustment of plug 22' in bolt recess 26' is accomplished by rotating the shuttle 32' to depress ball 37 to cause spring-loaded pin 38*a* or 38*b* to move against respective springs 35 and 42 to exit radial passageway 46 in bolt 21' thus allowing bolt plug 22' to clear bolt 21' and thereafter be moved axially in either direction of two-headed arrow (FIG. 13) until one of spring-loaded driver pins 38*a*, 38*b* is positioned for release and entry into passageway 46. The depression of ball 37 is accomplished by shuttle 32' (hidden in FIG. 13 but shown in FIGS. 12, 14, 15 and 16). Unlike the first embodiment, plug 22' does not rotate but moves axially as limited by plug notch 47 and pin D fixed in deadbolt 21' and extending into and across notch 47 (FIG. 12). Driver 23' fits loosely in groove 22*a* of plug 22' to permit rotation of driver 23' with rotation of plug 22'.

Shuttle 32' which includes curved body 33', anchor extension 32*a'* and a deadbolt actuator piece 32*b'*, is located in space 21*g'* between flat-sided bolt 21' and cylindrical housing 16'. Shuttle 32' is locked to housing 16' and its integral plate 16*a'* as anchor extension 32*a'* engages between back plate 16' and fore plate A'. Since shuttle 32' is enclosed between case halves 11*a'*, 11*b'* and the flat side of deadbolt 21', the turning of the case halves of housing 11' turns shuttle 32' to bring its indented ball actuator pieces 32*b'* into engagement with ball 37 and, as there is further turning of case housing 11' ball 37 is depressed to accomplish bolt train 19' adjustment as described above. Plug 22' has annular groove 22*a'* for receiving in clamping engagement so that rotation of driver 23' rotates plug 22'.

Figure 15:
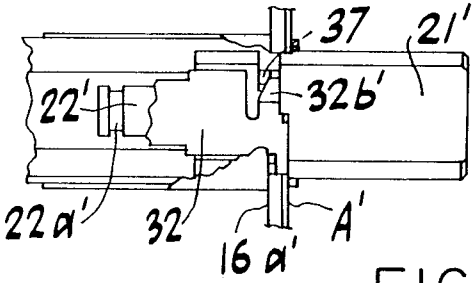
FIG. 15 is a partial longitudinal sectional view showing the shuttle engaging the depressible ball.
Figure 16:
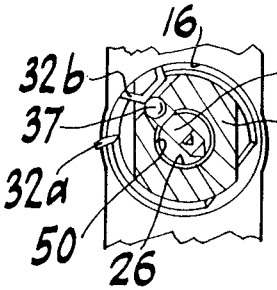
FIG. 16 is a transverse sectional view showing the shuttle and ball in contact.

Turning to FIGS. 14, 15 and 16, shuttle 32' with its ball actuator 32*b'* is shown engaging and depressing ball 37. FIG. 16 shows the ball 37 in the process of being depressed against spring 33, 42. Since body 16 remains stationary (FIG. 16), pin 38*a'*, as shuttle 32' turns further, will clear the shear line 50 defined by the outside cylindrical dimension of cylindrical internal bolt recess 26' and thereafter bolt 22' becomes free to reciprocate for backset adjustment in either axial direction.

We claim:

1. A backset latch mechanism adjustable before installation having a housing, including a cylindrical housing and a casing housing movable in the cylindrical housing, a swivel mounted in the casing housing, a housing back plate attached to the cylindrical housing and a face plate adjacent to the back plate and a bolt train including a deadbolt reciprocal within the casing housing for movement by the swivel, the improvement for accomplishing backset adjustment prior to installation comprising a. an internal recess in the deadbolt;

b. an adjustment plug reciprocally mounted within the deadbolt recess;

c. locking means locking the plug to the deadbolt in at least two positions;

d. turnable shuttle means positioned between the deadbolt and the cylindrical housing to prevent axial movement of such shuttle means relative to the cylindrical housing at all times and to selectively engage the deadbolt during backset adjustment to prevent deadbolt axial movement and also causing the locking means to release and unlock the adjustment plug from the deadbolt to accomplish backset adjustment.

2. The backset latch mechanism of claim 1 in which the shuttle means is held between the back and face plates and is contained between the deadbolt and the cylindrical housing whereby rotation of the casing housing causes the shuttle means to turn and to actuate the locking means.

3. The backset latch mechanism of claim 2 in which the casing housing has two sections joined by a follower and opening means spaced apart from one another and in which backset adjustment of the mechanism through its locking means is accomplished at the same time by rotation and axial movement of the casing housing.

4. The backset latch mechanism of claim 1 in which the locking means is spring-loaded and includes a radial passageway in the deadbolt and detent means in the passageway movable radially from a lock to an unlock position.

5. The backset latch mechanism of claim 1 in which the cylindrical housing and casing housing are adjusted to vary their backset as the bolt train is so adjusted.

6. A backset latch mechanism adjustable before installation having a housing, including a cylindrical housing and a casing housing movable in the cylindrical housing, a swivel mounted in the casing housing, a housing back plate attached to the cylindrical housing and a face plate adjacent to the back plate and a bolt train including a deadbolt reciprocal within the casing housing for movement by the swivel, the improvement for accomplishing backset adjustment prior to installation comprising a. an internal recess in the deadbolt;

b. an adjustment plug reciprocally mounted within the deadbolt recess;

c. locking means locking the plug to the deadbolt in at least two positions;

d. turnable shuttle means positioned between the deadbolt and the cylindrical housing to prevent axial movement of such shuttle means relative to the cylindrical housing at all times and to engage the deadbolt only during backset adjustment.

* * * * *

UNITED STATES PATENT AND TRADEMARK OFFICE

CERTIFICATE OF CORRECTION

PATENT NO. : 4,979,768

DATED : December 25, 1990

INVENTOR(S) : Robert A. Marotto and Mohamed L. Benchaar

It is certified that error appears in the above-identified patent and that said Letters Patent is hereby corrected as shown below:

Column 3, line 2, "154" " should read -- 3/8" --.

Column 3, line 16, "11a'," should read -- 11a'. --.

Column 3, line 20, "for plate" should read -- fore plate --.

Signed and Sealed this

Twenty-third Day of June, 1992

*Attest:*

DOUGLAS B. COMER

*Attesting Officer*

*Acting Commissioner of Patents and Trademarks*